US008950355B2

(12) United States Patent
Ikushima

(10) Patent No.: US 8,950,355 B2
(45) Date of Patent: Feb. 10, 2015

(54) DESKTOP WORKING APPARATUS

(75) Inventor: Kazumasa Ikushima, Mitaka (JP)

(73) Assignee: Musashi Engineering, Inc., Tokyo (JP)

( * ) Notice: Subject to any disclaimer, the term of this patent is extended or adjusted under 35 U.S.C. 154(b) by 269 days.

(21) Appl. No.: 13/513,441

(22) PCT Filed: Nov. 29, 2010

(86) PCT No.: PCT/JP2010/071235

§ 371 (c)(1),
(2), (4) Date: Aug. 10, 2012

(87) PCT Pub. No.: WO2011/068087

PCT Pub. Date: Jun. 9, 2011

(65) Prior Publication Data

US 2012/0298038 A1 Nov. 29, 2012

(30) Foreign Application Priority Data

Dec. 1, 2009 (JP) ..... 2009-274009

(51) Int. Cl.
*B05C 13/02* (2006.01)
*B05B 13/02* (2006.01)
(Continued)

(52) U.S. Cl.
CPC ..... *B05B 13/0463* (2013.01); *B05B 12/122* (2013.01); *B05B 15/0208* (2013.01); *B05B 15/1203* (2013.01)
USPC ..... 118/305; 118/500; 118/313; 118/315; 118/324; 118/687

(58) Field of Classification Search
CPC ..... B05C 13/00; B05B 15/1203
USPC ..... 118/313–315, 323, 305, 324, 663, 118/679–681, 687, 500; 427/427.1; 188/686
See application file for complete search history.

(56) References Cited

U.S. PATENT DOCUMENTS 5,134,665 A * 7/1992 Jyoko ..... 382/150
6,808,592 B1 * 10/2004 Rigali et al. ..... 156/345.31
(Continued)

FOREIGN PATENT DOCUMENTS

CN 101386232 A 3/2009
JP 4-222656 A 8/1992
(Continued)

OTHER PUBLICATIONS

Chinese Office Action dated Sep. 23, 2014, issued in corresponding CN application No. 201080062921.0 with English translation (8 pages).

*Primary Examiner* — Yewebdar Tadesse
(74) *Attorney, Agent, or Firm* — Westerman, Hattori, Daniels & Adrian, LLP

(57) ABSTRACT

Provided is a full-automatic working apparatus which has a work-object conveying mechanism and can be used on a desk. The desktop working apparatus works a work-object as desired by moving relatively the work-object and a working head. The desktop working apparatus comprises a base desk, a working section placed on the base desk and having a working head and a working-head-driving mechanism, a loader placed integrally at the side portion of the desktop working apparatus, an unloader placed integrally at the side portion of the desktop working apparatus, a conveying section placed on the base desk to convey the work-object fed by the loader to the unloader, and a controlling section; the conveying section having a fixing mechanism for fixing the work-object at the working position, the working section having a working head placed above the working position, the controlling section having a first controller unit placed in the base desk and a second controller unit placed at the side portion or upper portion of the tabletop working apparatus.

24 Claims, 8 Drawing Sheets

(51) Int. Cl.

| | |
|---|---|
| ***B05C 11/10*** | (2006.01) |
| ***B05B 13/04*** | (2006.01) |
| ***B05B 12/12*** | (2006.01) |
| *B05B 15/02* | (2006.01) |
| *B05B 15/12* | (2006.01) |

(56) References Cited

U.S. PATENT DOCUMENTS

| | | | | |
|---|---|---|---|---|
| 2006/0029724 | A1* | 2/2006 | Babiarz et al. | 427/64 |
| 2009/0066777 | A1 | 3/2009 | Tatewaki et al. | |
| 2011/0042478 | A1 | 2/2011 | Ikushima | |

FOREIGN PATENT DOCUMENTS

| | | | |
|---|---|---|---|
| JP | 8-229478 | A | 9/1996 |
| JP | 2002-355723 | A | 12/2002 |
| JP | 2003-145022 | A | 5/2003 |
| JP | 2005-088127 | A | 4/2005 |
| JP | 2009-190012 | A | 8/2009 |

* cited by examiner (a)

(b)

DESKTOP WORKING APPARATUS

TECHNICAL FIELD

The present invention relates to a desktop working apparatus, which includes a workpiece conveying mechanism and which performs desired operations on a workpiece.

In this description, the term "full-automatic working apparatus" implies a working apparatus in which carrying-in of a workpiece to a working place, operations on the workpiece at the working place, and carrying-out of the workpiece from the working place are performed in a full-automatic manner. Practical examples of the full-automatic working apparatus, disclosed here, include an apparatus for automatically repeating the steps of taking one workpiece out of a magazine containing plural workpieces, performing desired operations on the workpiece, and taking the workpiece after the operations into the magazine, and an apparatus for automatically repeating the steps of performing desired operations on a workpiece carried in from an apparatus in a preceding step, and carrying out the workpiece to an apparatus in a succeeding step.

BACKGROUND ART

A working apparatus is used to perform desired operations, such as application of a liquid, lubrication, press-fitting of a pin, assembling, soldering, and screw fastening, on one or more desired positions of a working object also called a work or a workpiece.

For example, Patent Document 1 discloses a full-automatic working apparatus that performs an operation of applying a liquid material to a workpiece.

The disclosed apparatus includes an applicator body for applying the liquid material to the workpiece, a loader for vertically moving a magazine table on which a magazine is placed, and supplying the workpiece contained in the magazine to the applicator body, and an unloader for vertically moving the magazine table on which the magazine is placed, and taking the workpiece, which is discharged from the applicator body, into the magazine, wherein the loader and the unloader are disposed on both sides of the applicator body and are vertically oriented with respect to plural magazine tables.

Like the apparatus disclosed in Patent Document 1, an apparatus of automatically successively performing a series of operations of automatically taking a workpiece out of a magazine that contains a plurality of workpieces, setting the workpiece on a work table after the workpiece has been automatically conveyed to the work table, and conveying the workpiece to be taken into the magazine after desired operations have been performed on the workpiece by a working apparatus, is called a full-automatic working apparatus.

Like an apparatus incorporated in a production line, an apparatus of automatically successively performing a series of operations of carrying in a workpiece from an apparatus in a preceding step, performing desired operations on the workpiece, and carrying out the workpiece after the operations to an apparatus in a succeeding step is also a full-automatic working apparatus.

Furthermore, that type of liquid material applying apparatus is generally a floor-standing working apparatus that is directly installed on a floor surface.

Patent Document 2 discloses a desktop working apparatus in which a guide mechanism is supported on a base body through a support column, and a tool mount table and a robot driving unit, e.g., a driver unit, are horizontally moved along the guide mechanism.

Patent Document 2 states that the desktop working apparatus is used for aiding, particularly, screw fastening, soldering, cleaning, assembling, application of a liquid, lubrication, press-fitting of a pin, and so on. As a screw fastening apparatus, for example, Patent Document 2 discloses an apparatus including a horizontal section formed at a top of the tool mounting table, a screw supply stocker that serves as a supply unit for holding parts necessary in individual working steps, and many small screws contained in the screw supply stocker, wherein the small screws are individually supplied to a fore end of the driver unit through a guide tube and are fastened in a predetermined way.

Like the apparatus disclosed in Patent Document 2, an apparatus of manually taking a workpiece out of, e.g., a storage case or a palette before starting operations, manually setting the workpiece on a working table, performing the desired operations on the workpiece by a working apparatus, and manually removing the workpiece after the operations from the working table is called a semi-automatic working apparatus.

The semi-automatic working apparatus differs from the full-automatic working apparatus in that, although the operations on the workpiece are performed by the working apparatus, the setting and the removal of the workpiece onto and from the working table and an operation start instruction for the working apparatus have to be made by a worker.

A desktop working robot without having the workpiece conveying function is employed as a semi-automatic working apparatus.

There are various working apparatuses ranging from a desktop size apparatus that is installed or placed on a workbench or a table when used, to an apparatus having a larger size than the desktop type, which is directly installed on the floor when used. One criterion for selecting which one of a full-automatic apparatus and a semi-automatic apparatus is to be used is a production quantity.

The full-automatic apparatus can automatically manufacture products without manual operations of the worker and can manufacture high-quality products. However, the apparatus has a large size and needs a large space for installation. Moreover, when a variety of products are manufactured, the apparatus becomes complicated and a lot of time and efforts are required for modifying setup of the apparatus corresponding to different types of products. For that reason, the full-automatic apparatus is adapted for mass production of one type of product.

On the other hand, the semi-automatic apparatus can be constructed as a compact apparatus capable of being used on a desk, can effectively utilize a space available for production, and can easily modify setup of the apparatus when the type of product is changed. However, because the worker has to manually set the workpiece, accuracy of the workpiece mounting position is apt to vary and worker's skills are required to provide product quality comparable to that obtained with the full-automatic apparatus. Moreover, the semi-automatic apparatus is inferior in production efficiency to the full-automatic apparatus. For that reason, the semi-automatic apparatus is adapted for small-quantity production of various types of products.

PRIOR ART LIST

Patent Documents

Patent Document 1: U.S. Pat. No. 4,373,041

Patent Document 2: Japanese Patent Laid-Open Publication No. H08-229478

SUMMARY OF THE INVENTION

Problems to be Solved by the Invention

Recently, higher working efficiency has been demanded particularly in the fields of research and development under influences of, e.g., diversification of market needs and shortening of the product life cycle. Various kinds of experimental equipment and measuring devices are necessary for research and development, but spaces in worksites are limited. Therefore, downsizing of individual apparatuses and devices is demanded.

As mentioned above, a floor-standing apparatus has relatively high working efficiency. However, a space for installing a full-automatic apparatus cannot be ensured in not-a-few worksites for research and development.

Stated another way, in most of laboratories and research rooms, various apparatuses and devices are arranged in a crowded fashion, and a sufficient space for installing the floor-standing apparatus is not left there. It is conceivable to create an installation space for the floor-standing apparatus by removing an existing working table and/or experimental table. However, this raises another problem that a new place for storing the removed working table and/or experimental table has to be prepared.

Moreover, from the viewpoint of more efficient use of a production space, an apparatus having a more compact size is also demanded in a production site manufacturing various types of products in small quantities. Further, there is a demand for increasing a production quantity without changing working environment to a large extent.

The present invention is intended to solve the above-described problems and to provide a full-automatic working apparatus, which includes a workpiece conveying mechanism and which can be used on a desk.

Means for Solving the Problems

According to a first aspect of the present invention, there is provided a desktop working apparatus for performing desired operations on a workpiece while the workpiece and a working head are relatively moved, the desktop working apparatus comprising a base body, a working section disposed on the base body and including the working head and a working head driving mechanism, a loader integrally disposed at a side of the desktop working apparatus, an unloader integrally disposed at a side of the desktop working apparatus, a conveying section disposed on the base body and conveying the workpiece supplied from the loader to the unloader, and a control unit, wherein the conveying section includes a fixing mechanism for fixedly holding the workpiece at a working position, the working section includes the working head disposed above the working position, and the control unit includes a first control unit disposed within the base body, and a second control unit disposed at a side or a top of the desktop working apparatus.

According to a second aspect of the present invention, in the desktop working apparatus according to the first aspect, the working head driving mechanism includes an X-axis driving mechanism for moving the working head parallel to a conveying direction of the conveying section, a Y-axis driving mechanism for moving the working head in a direction perpendicular to the conveying direction of the conveying section, and a Z-axis driving mechanism for moving the working head in an up and down direction, the Y-axis driving mechanism being disposed in overhanging relation to the conveying section.

According to a third aspect of the present invention, in the desktop working apparatus according to the first or second aspect, the conveying section includes a conveying rail disposed on the base body and conveying the workpiece, an application stage arranged at the working position, and a fixing member for fixedly sandwiching the workpiece at the working position.

According to a fourth aspect of the present invention, the desktop working apparatus according to any one of the first to third aspects further comprises a casing that is disposed on the base body and that covers the working section and the conveying section.

According to a fifth aspect of the present invention, in the desktop working apparatus according to the fourth aspect, the second control unit is disposed at a side or a top of the casing.

According to a sixth aspect of the present invention, in the desktop working apparatus according to any one of the first to fifth aspects, the first control unit is a control unit for controlling the working head driving mechanism and the conveying section and the second control unit is a control unit for controlling the working head, or the first control unit is a control unit for controlling the working head and the second control unit is a control unit for controlling the working head driving mechanism and the conveying section.

According to a seventh aspect of the present invention, in the desktop working apparatus according to any one of the first to sixth aspects, the loader moves a plurality of vertically stacked magazine tables up and down while always holding constant a relative distance between the adjacent magazine tables, and supplies the workpiece contained in the magazine to the conveying section, the magazine being placed on the magazine table, and the unloader moves a plurality of vertically stacked magazine tables up and down while always holding constant a relative distance between the adjacent magazine tables, and takes in the workpiece discharged from the conveying section into the magazine that is placed on the magazine table.

According to an eighth aspect of the present invention, in the desktop working apparatus according to the seventh aspect, a height of the workpiece placed on the conveying section is greater than a length from a lower end of the magazine table to an upper end of the magazine placed on the magazine table.

According to a ninth aspect of the present invention, in the desktop working apparatus according to any one of the first to eighth aspects, a height of the base body is ½ or less of a height of the desktop working apparatus.

According to a tenth aspect of the present invention, in the desktop working apparatus according to any one of the first to ninth aspects, the working section includes the working head, a distance measurement device, and an image pickup device, which are integrally disposed in series parallel to the conveying direction of the conveying section.

According to an eleventh aspect of the present invention, in the desktop working apparatus according to any one of the first to tenth aspects, the working head is an ejection head.

Advantageous Effect of the Invention

With the present invention, since the desktop working apparatus is provided which can be used on a desk with no need of preparing a space for installing the full-automatic working apparatus on the floor, a production quantity can be increased without changing working environment to a large extent.

Further, since the working apparatus according to the present invention can, though being of desktop type, successively perform desired operations on plural workpieces without manually setting the workpieces, productivity can be increased even in a space that has a limitation in installing apparatuses.

MODE FOR CARRYING OUT THE INVENTION

Figure 1:
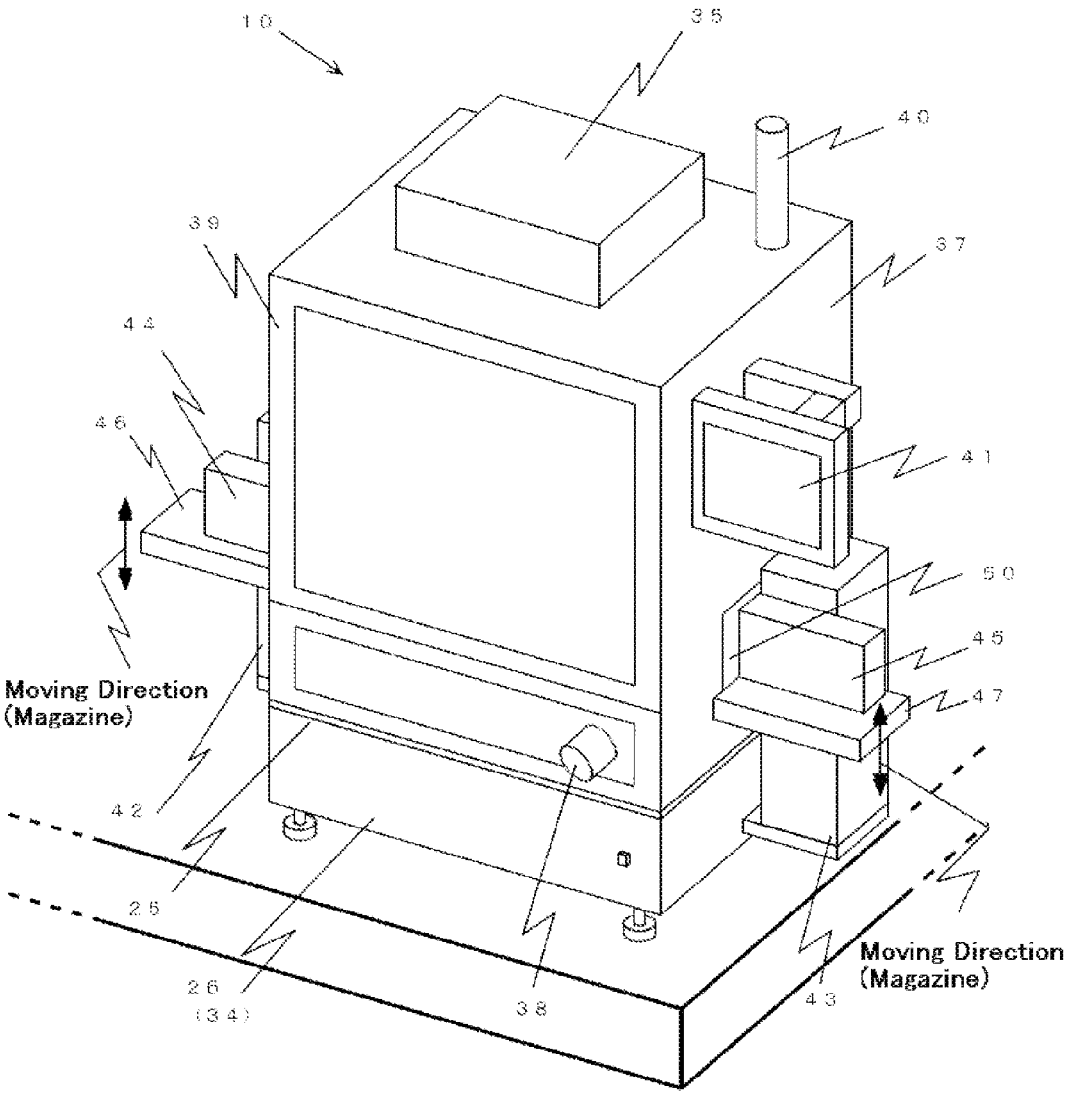
FIG. 1 is a schematic overall perspective view of a desktop liquid-material applying apparatus according to the present invention.

A practical mode of a desktop working apparatus according to the present invention will be described below in connection with an example of a full-automatic liquid-material applying apparatus including a working section and a conveying section, which are disposed within a casing provided on a base body, and a loader and an unloader, which are disposed laterally of the casing. The full-automatic liquid-material applying apparatus according to the present invention is constructed on the basis of the following basic concepts.

(i) Reduce a height of the base body. In particular, hold heights of sections/portions where operations are made by a worker (such as the conveying section, magazine charging and discharging portions, etc.) within a certain range from a contact ground surface.

(ii) Reduce a depth size of the base body in a direction away from the worker.

(iii) Provide legs with which the apparatus can be installed even on a relatively narrow contact ground surface without losing stability.

The above item (i) implies a construction taking into account easiness in operations made by the worker. A magazine is manually charged into the loader by the worker. In order to facilitate the magazine charging performed by the worker, the magazine charging portion is preferably positioned at a level lower than the chest of the worker. For example, when the height of a desk is about 70 cm, the magazine charging portion is positioned 80 cm or less as the least condition, preferably 60 cm or less, and more preferably 50 cm or less above the desk.

In that respect, the magazine charging portion can be positioned at a low level arranging the loader laterally of the base body, the loader moving a plurality of vertically stacked magazine tables up and down while a relative distance between the adjacent magazine tables is always held constant, and further supplying the workpiece contained in the magazine, which is placed on the magazine table, to a main body of the liquid-material applying apparatus. Even with the magazine capable of being easily charged, however, when the conveying section is disposed at a high position, there is a problem that the worker cannot visually confirm an upper surface of the workpiece, i.e., the working object. It is, therefore, important that the conveying section is also arranged at such a height as enabling the worker to visually confirm the upper surface of the workpiece. In other words, given that the height of the desk is about 70 cm, the upper surface of the workpiece placed on the conveying section is positioned 80 cm or less as the least condition, preferably 60 cm or less, and more preferably 50 cm or less above the desk.

To realize the above-described arrangement, the height of the base body on which the conveying section is disposed needs to be held not higher than a certain level. Up to date, however, a large-sized control unit for controlling an overall operation of the apparatus is disposed within the base body, and there is a limitation in reducing the height of the base body. In view of such a point, according to the present invention, the control unit is arranged in a way distributed per function so that the height of the base body can be reduced. More specifically, the height of the base body is reduced by separating the control unit per function into, e.g., a driving system control unit, an ejection system control unit, and an image-processing system control unit, and by distributively arranging those control units at different positions from each other, including positions above and laterally of the working section.

Meanwhile, it is not desirable in some cases to extremely reduce the height of the base body. The reason is that, when there are plural magazine tables, a difficulty arises in positioning the magazine table in a lower stage below the conveying section (i.e., laterally of the base body) while positioning the magazine table in an upper stage to be aligned with the conveying section. Further, if the height of the base body is extremely low, the worker has to bend the body when the worker is going to make operations in a standing posture. Accordingly, it can be said that the base body preferably has a certain height (thickness). For that reason, at least one of the distributed control units is preferably disposed within the base body.

While the height of the base body 26 is a matter of choice in design depending on, e.g., the working posture of the worker and linkage with other production lines, the height of the base body is to be, for example, ½ or less as the least condition, preferably ¼ to ⅙, and more preferably ⅕ to ⅙ with respect to the overall height of the apparatus from the viewpoint of versatility in practical use.

The above item (ii) implies a construction taking into account an installation area and a situation where an extra space on the desk is utilized as a working space. In other words, when an area of the base body is small, the apparatus of the present invention can be placed on a small desk, and magazines, etc. can be put in the extra space on the desk.

A problem in trying to reduce the depth size of the base body in the direction away from the worker is layout of a working position. Because the conveying section is essentially disposed on the base body, the depth size of the base body is inevitably increased when the working position is disposed in side-by-side relation to the conveying section. For example, it is conceivable to construct the conveying section by two conveying rails parallel to each other, to move the workpiece on the conveying section by pushing it in the depth direction by a reciprocally moving mechanism, and to return the workpiece to the conveying rails by the reciprocally moving mechanism again after operations have been performed on the workpiece at the working position. In such a case, the conveying rails, the working position, and a working head driving mechanism are arranged in series in the depth direction, and the depth size of the base body cannot be reduced.

In view of the above-described problem, according to the present invention, the number of components arranged in series in the depth direction is reduced by disposing the working position in the conveying section. Further, according to the present invention, the working head driving mechanism is positioned in overhanging relation to the conveying section such that the components hitherto arranged in series in the depth direction are arranged in overlapped relation in the height direction. With such an arrangement, the present invention can reduce the depth size of the base body even with a structure that the conveying section is disposed on the base body.

Furthermore, it is preferable to reduce the depth size of the base body by arranging an operating unit on a side surface of the working apparatus.

Moreover, in the case where an image pickup device and a distance measurement device are disposed on the working head driving mechanism, it is possible to substantially eliminate movements in the depth direction (Y-direction) perpendicular to the conveying direction (X-direction) when application, image pickup, and measurement are performed, by mounting an ejection device, the image pickup device, and the distance measurement device in series in the conveying direction. Such an arrangement is preferable in reducing the size in the depth direction (Y-direction) and in cutting the operation time corresponding to the elimination of the movements in the depth direction.

The above item (iii) implies a construction enabling the apparatus to be installed on a small desk or on a desk, which is large in itself, but which has a small extra space, without losing stability.

The liquid-material applying apparatus is required to have a high levelness because it apples a liquid to the upper surface of the workpiece. Accordingly, legs for supporting the base body is constituted by four or more legs which are each adjustable in height. The reason why each leg is made adjustable in height resides in making levelness adjustable with respect to the desk that provides a plane on which the apparatus is installed. The legs are positioned near corners of the base body and are arranged at the same interval therebetween.

Further, the loader and the unloader are arranged in non-contact with the upper surface of the desk. This is intended to eliminate the need of adjusting the heights of the loader and the unloader, the adjustment being otherwise necessary to maintain levelness of the conveying section.

By employing the constructions described above, the area required for installing the apparatus can be reduced without losing stability.

Details of the present invention will be described in detail in connection with an embodiment. It is, however, to be noted that the present invention is in no way limited by the following embodiment.

Embodiment 1

Embodiment 1 represents an example of a desktop full-automatic liquid-material applying apparatus in which the present invention is applied to a liquid-material applying apparatus for applying a liquid material to a workpiece.

Figure 2:
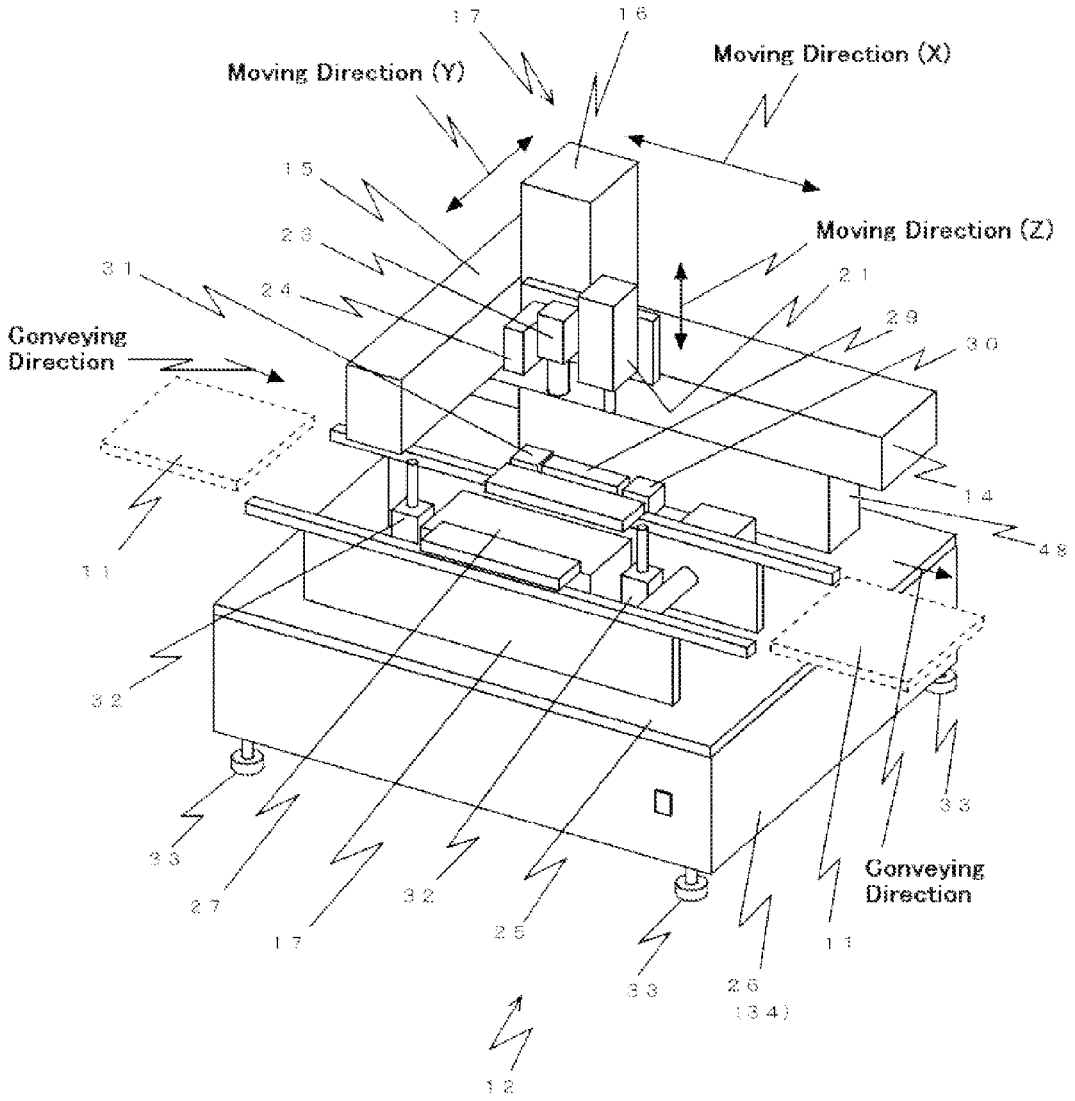
FIG. 2 is a schematic perspective view of a main body of the desktop liquid-material applying apparatus according to the present invention.

FIG. 1 is a schematic overall perspective view of the desktop full-automatic liquid-material applying apparatus according to this embodiment, and FIG. 2 is a schematic perspective view of a main body of the desktop full-automatic liquid-material applying apparatus according to this embodiment. The following description is made with reference to FIGS. 1 and 2.

The desktop full-automatic liquid-material applying apparatus 10 according to this embodiment has such a basic construction that a main body 12 is arranged at a center, and a loader 42 and an unloader 43 are disposed at sides of the main body. The main body 12 includes a workpiece conveying mechanism 17 and a head moving mechanism 13 on one base plate 25, and a first control unit 34 under the base plate 25, the first control unit 34 controlling the workpiece conveying mechanism 17 and the head moving mechanism 13.

The head moving mechanism 13 moves an ejection device 21, which ejects the liquid material, in XYZ-directions with respect to the workpiece.

The head moving mechanism 13 is constituted by an X-axis driving mechanism 14, a Y-axis driving mechanism 15, and a Z-axis driving mechanism 16. Those driving mechanisms are all installed on a pedestal 48 in match with the height of the workpiece conveying mechanism 17. With that arrangement, when the Y-axis driving mechanism 15 is disposed in overhanging relation to the workpiece conveying mechanism 17, the Y-axis driving mechanism 15 is held at such a height that it does not strike against or interfere with the workpiece conveying mechanism 17.

In this embodiment, a combination of an electric motor and a ball screw is used as each of the driving mechanisms 14 to 16. It is to be noted that the structure of each driving mechanism is not limited to the one used in this embodiment, and various mechanisms can be optionally used. For example, the driving mechanism may be constructed by using a linear motor, or a mechanism for transmitting motive power through a belt and a chain, for example.

The workpiece conveying mechanism 17 includes conveying rails 18 for transferring a workpiece 11, i.e., an application object, from a magazine placed on the loader 42 to an application stage 27 where the liquid material is applied, and then to a magazine placed on the unloader 43. The conveying rails 18 are disposed at a level (height of 350 mm above a desk) higher than that of the magazine when the magazine is put on an upper surface of the desk.

In the workpiece conveying mechanism 17 of this embodiment, round belts are stretched respectively along two rails and are each operated to circulate by, e.g., a motor. The workpiece 11 is conveyed in a state resting on the belts. While the two round belts are used in this embodiment, the conveying mechanism is not limited to that example. As other examples, one belt may be used instead of the two belts, and a mechanism other than the belt may be used. The reason of employing the mechanism including the belts stretched over the two conveying rails 18 resides in making a width of the workpiece conveying mechanism 17 adjustable depending on a size of the workpiece 11.

The application stage 27 for fixedly holding the workpiece during application work and two stoppers 32 for stopping the workpiece 11 at predetermined positions are disposed between the two conveying rails 18 of the workpiece conveying mechanism 17.

The stopper 32 on the upstream side is disposed near the application stage 27 on the side closer to the loader, and the stopper 32 on the downstream side is disposed near the application stage on the side closer to the unloader. The upstream-side stopper 32 serves to prevent two or more workpieces from being conveyed to the working position during the application work, and the downstream-side stopper 32 serves to properly position the workpiece that is conveyed to the working position.

In some of other apparatuses including similar workpiece conveying mechanisms, the conveying mechanism is separated into two parts on both sides of the stopper position, and motors, etc. are disposed respectively in the two parts to drive separate mechanisms independently of each other. In this embodiment, however, the workpiece conveying mechanism 17 is constituted by one driving system. As a result, it is possible to reduce an installation space for the motor and other parts, and to reduce the weight. A manner of fixedly holding the workpiece 11 by the application stage 27 will be described later.

A calibration unit 28 used in a preparation phase before starting the application work is disposed between the head moving mechanism 13 and the workpiece conveying mechanism 17.

The calibration unit 28 is constituted by an adjustment stage 29 on which a test application of the liquid material is performed for adjusting an application position and an application amount, by a touch sensor 30 used in adjusting a reference position for the height of a fore end of a nozzle included in the ejection device 21, and by a nozzle cleaning mechanism 31 for removing an extra liquid material adhering to the fore end of the nozzle included in the ejection device 21.

The workpiece 11 used for adjustment is placed on the adjustment stage 29. By installing the calibration unit 28 between the workpiece conveying mechanism 17 and the head moving mechanism 13, the installation space can be reduced in comparison with the case where the calibration unit 28 is disposed on the side oppositely away from the head moving mechanism 13 with the workpiece conveying mechanism 17 disposed therebetween.

The loader 42 and the unloader 43 move the magazines in the up and down directions.

In this embodiment, a combination of an electric motor and a ball screw is used as a driving mechanism for each of the loader 42 and the unloader 43.

A first control unit 34 for controlling operations of the driving systems (i.e., the workpiece conveying mechanism 17, the head moving mechanism 13, the loader 42, and the unloader 43) is incorporated within the base body 26. Height-adjustable legs (adjuster pads) 33 for supporting the apparatus are provided at four corners of an under surface of the base body 26.

The applying apparatus 10 further includes a cover 37 covering the workpiece conveying mechanism 17 and the head moving mechanism 13, which are disposed on the one base plate.

An emergency stop button 38 is disposed on the front side of the cover 37 in its lower portion, and a door 39 is disposed on the front side of the cover 37 in its upper portion in an openable/closable manner.

Figure 7:
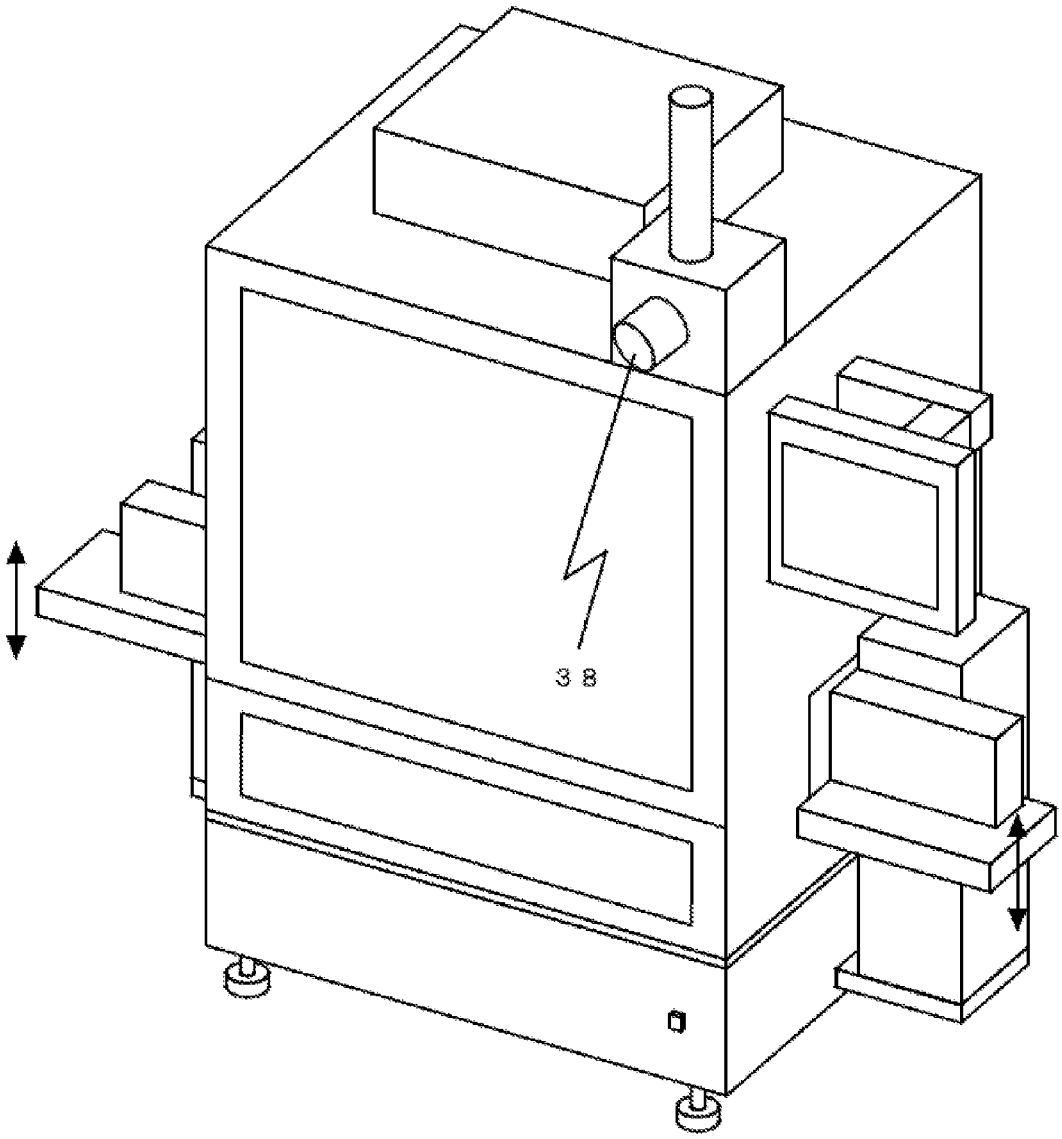
FIG. 7 is a schematic overall perspective view of an apparatus of a configuration example in which an emergency stop button is arranged at a top of the apparatus.

In this embodiment, the emergency stop button 38 is disposed at such a position that the worker can easily push the button when performing the operations in a sitting posture. However, when the worker performs the operations in a standing posture, the emergency stop button 38 may be disposed in the upper portion of the cover 37, as illustrated in FIG. 7. As a matter of course, the emergency stop button 38 may be disposed in each of the upper and lower portions of the cover 37.

A second control unit 35 for controlling the ejection device 21 and an indicating lamp 40 for indicating the operation status of the apparatus with turning-on/off of a light are disposed on an upper surface of the cover 37.

The second control unit 35 is contained in a box such that it can be exchanged depending on the type of the working head. The second control unit is operated in accordance with a signal from the first control unit, and the first control unit 34 can receive a signal that is related to the ejection of the liquid material and that is sent from the second control unit 35.

An operating unit (touch panel) 41 is disposed on a side surface of the cover 37.

The type of the ejection device 21 can be optionally selected depending on the working purpose. Examples of the ejection device 21 includes the air type supplying air, which is under a regulated pressure, for a desired time to the liquid material in a syringe having a nozzle at its fore end, the tubing type including a flat tubing mechanism or a rotary tubing mechanism, the plunger type ejecting the liquid material by moving, through a predetermined distance, a plunger sliding in close contact with an inner surface of a storage container that has a nozzle at its fore end, the screw type ejecting the liquid material with rotation of a screw, the valve type ejecting the liquid material under a desired pressure in a controllable manner with opening/closing of a valve, the jet type ejecting the liquid material so as to fly from a nozzle end by striking a valve member against a valve seat, and the ink jet type operating in a continuous jetting mode or an on-demand mode.

The ejection device 21 in this embodiment is provided integrally with an image pickup device 23 for taking images of an alignment mark on the workpiece 11 and the liquid material after being applied, and with a distance measurement device 24 for measuring a distance (height) from the surface of the workpiece 11.

In this embodiment, the image pickup device 23 employs a CCD camera to execute image processing. The distance measurement device 24 is constituted as a laser (optical) displacement meter that is usually employed for measurement of a distance. The types of the image pickup device 23 and the distance measurement device 24 can be optionally selected depending on the working purpose. For example, when the image pickup device 23 is of digital type, it is adapted for image processing. When the distance measurement device 24 is of non-contact type, it is adapted for performing the measurement without causing influences on the workpiece.

Moreover, this embodiment includes a third control unit 36 having the image processing function.

Figure 8:
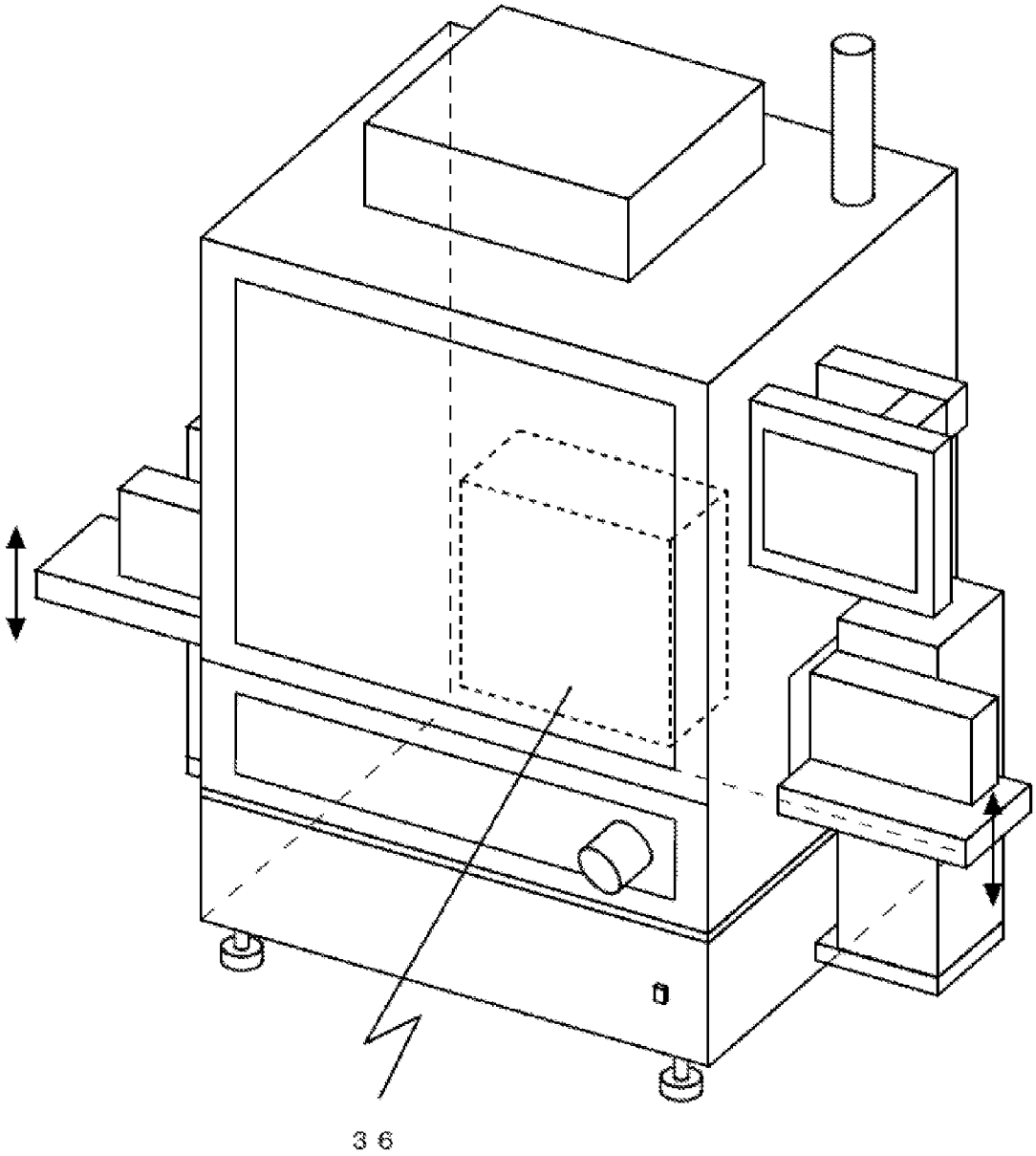
FIG. 8 is a schematic overall perspective view of an apparatus of a configuration example in which a third control unit is disposed on the backside of a main body of the apparatus.

As illustrated in FIG. 8, the third control unit 36 (denoted by dotted lines) for executing image processing, etc. may be installed on a rear surface of the cover. Alternatively, the third control unit 36 may be disposed, for example, under the table desk (close to the worker's feet). Of course, the third control unit 36 may be incorporated under the base plate 25 as with the first control unit 34, or may be arranged on the upper surface of the cover 37 as with the second control unit 35.

The loader 42 and the unloader 43 are disposed respectively on both side surfaces of the cover 37 in opposed relation. An opening 50 is formed in each of both the side surfaces of the cover 37 at a position where the workpiece 11 passes. The loader 42 includes a table A 46 on which the magazine is placed, the magazine containing plural workpieces 11 that are not yet subjected to the application work and that are stacked one above another in the up and down direction. The placement table A 46 is moved in the up and down direction such that the workpieces 11 can be successively taken out one by one. The unloader 43 includes a table B 47 on which the magazine is placed, the magazine containing plural workpieces 11 that have been subjected to the application work and that are stacked one above another in the up and down direction. The placement table B 47 is moved in the up and down direction such that it can successively take in the workpieces 11 one by one. The loader 42 and the unloader 43 are fixedly mounted on the base body 26 in a detachable manner.

A manner of fixedly holding the workpiece 11 at the working position by the application stage 27 will be described below with reference to FIG. 3.

Figure 3:
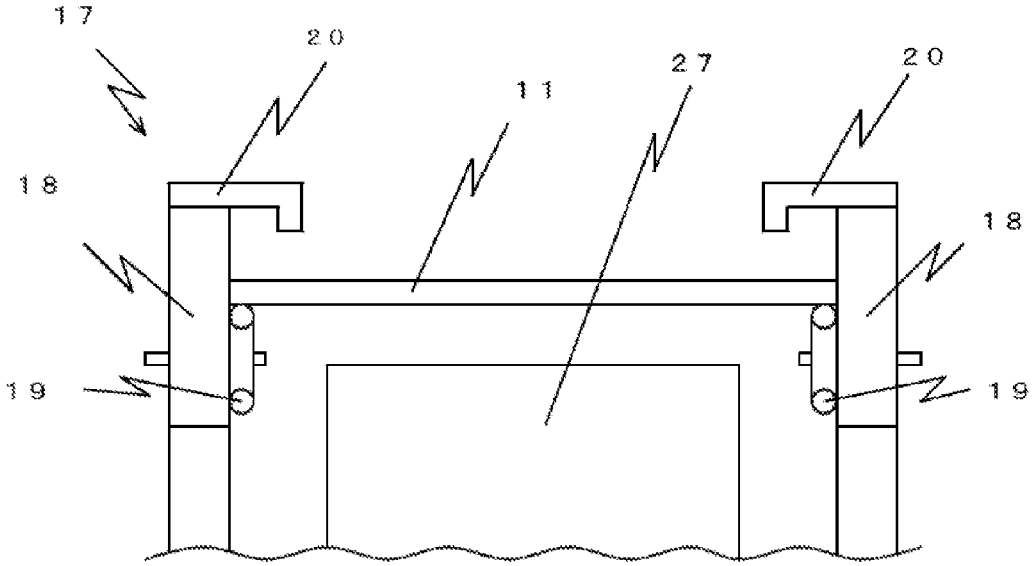
FIG. 3 is an explanatory view to explain a workpiece fixing mechanism in a desktop liquid-material applying apparatus according to an embodiment.
Figure 3:
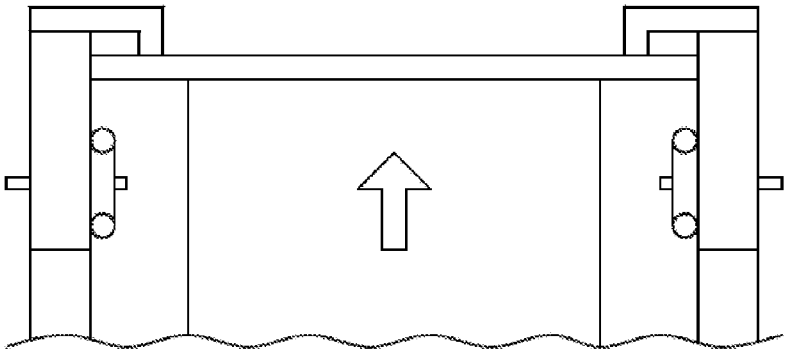

FIG. 3 is a sectional view of the conveying mechanism when viewed from the unloader side. FIG. 3(*a*) illustrates a state where the workpiece 11 is under the conveying, and FIG. 3(*b*) illustrates a state where the workpiece 11 is fixedly held.

A workpiece fixing member 20 having a hook-like shape or an L-shape in a cross-section is mounted on each conveying rail 18 within a range over which the application stage 27 is disposed, in such a posture that a distal end of a short side of the workpiece fixing member 20 is directed to a belt 19.

Between the distal end of the short side of the workpiece fixing member 20 and the belt 19, a gap is left in a size larger than a thickness of the workpiece 11 so as not to interfere with the conveying of the workpiece 11.

During the conveying, as illustrated in FIG. 3(*a*), the application stage 27 is descended to a level of an upper running portion of each belt 19, and the workpiece 11 is conveyed in a state resting on the belts 19.

As illustrated in FIG. 3(*b*), when the workpiece 11 is conveyed onto the application stage 27 and then fixedly held on it, the application stage 27 is ascended to lift the workpiece 11 from the belts 19, thereby sandwiching the workpiece 11 between the application stage 27 and the workpiece fixing members 20. The workpiece 11 is thereby fixedly held.

The application stage 27 can be driven to ascend and descend by using a mechanism such as an air cylinder or a combination of an electric motor and a ball screw.

Furthermore, the workpiece 11 may be fixedly held by some other method than mechanically sandwiching it. For example, a vacuum source may be connected to the application stage such that the workpiece 11 can be fixedly held on the upper surface of the application stage 27 under vacuum suction.

[Operation Flow]

Figure 4:
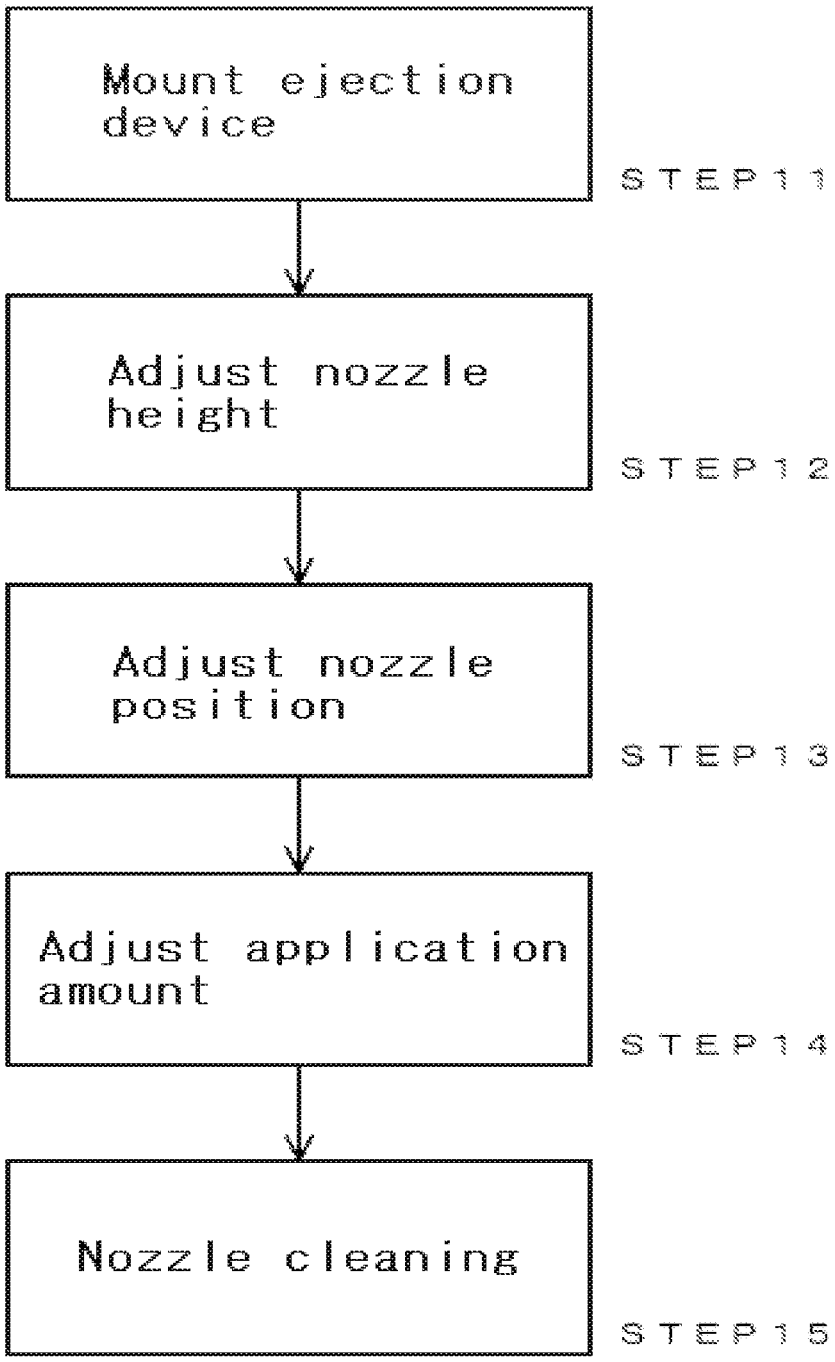
FIG. 4 is a flowchart to explain a preparation phase of the desktop liquid-material applying apparatus according to the embodiment.
Figure 5:
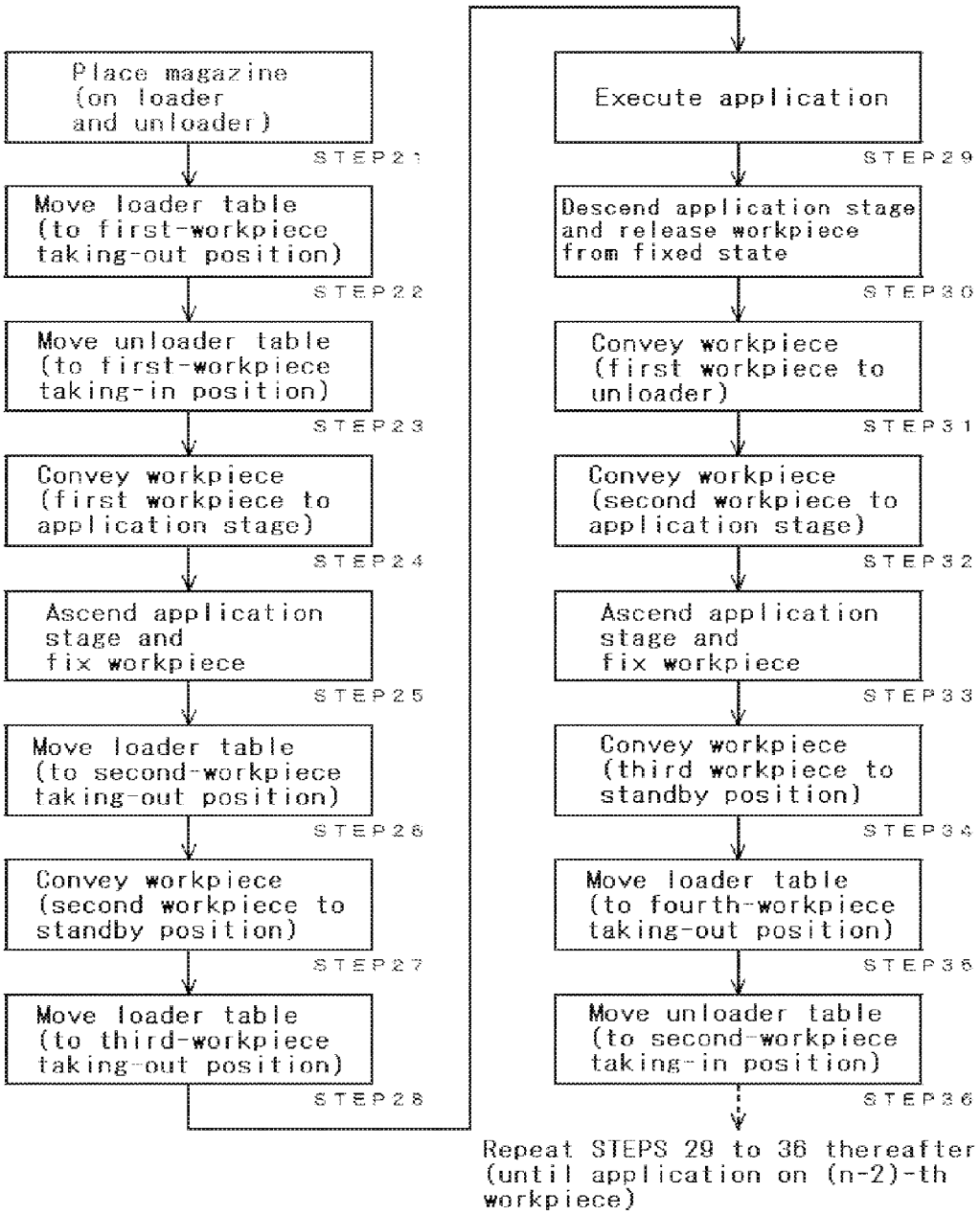
FIG. 5 is a flowchart to explain a starting part of an application phase of the desktop liquid-material applying apparatus according to the embodiment.
Figure 6:
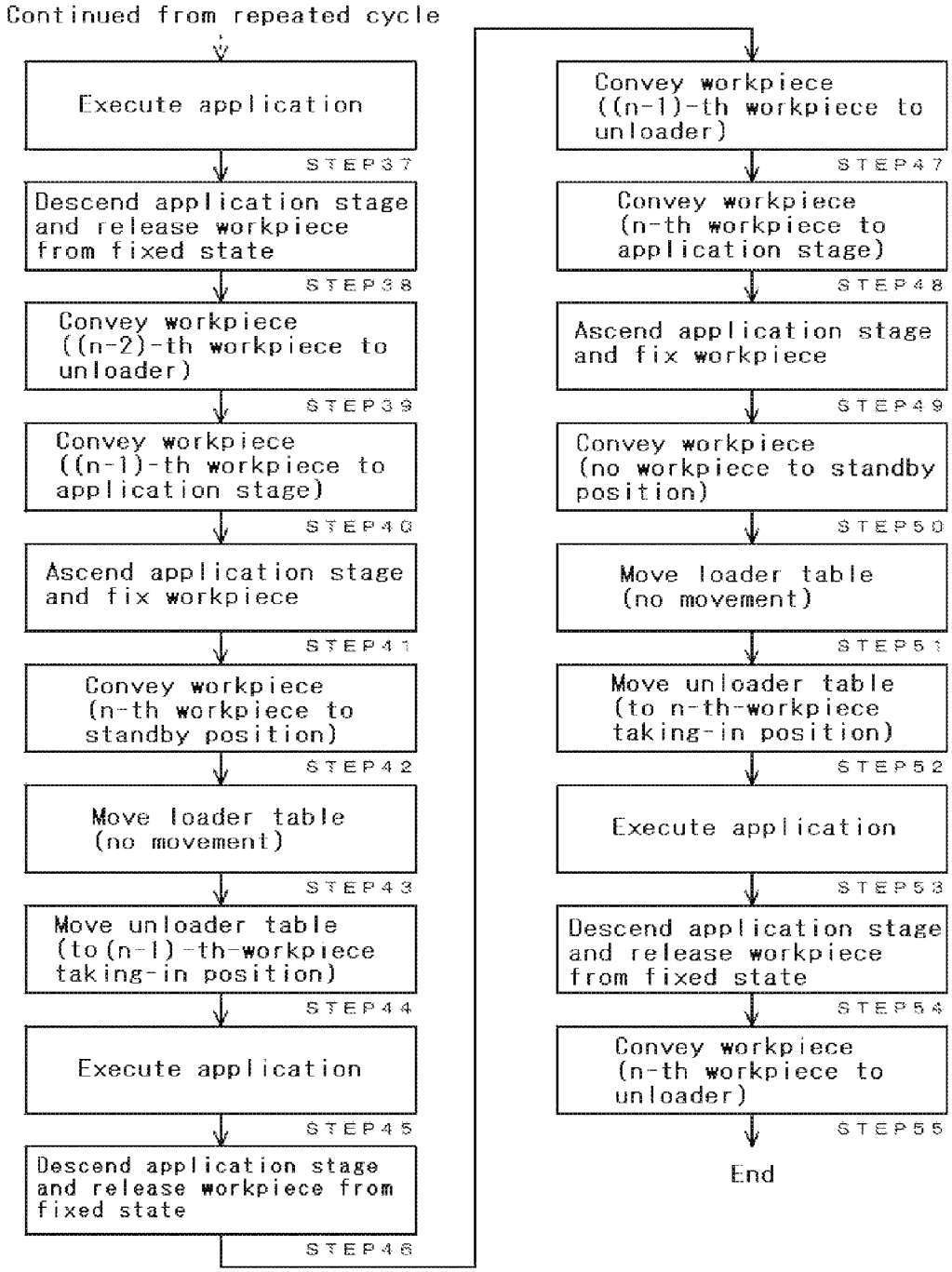
FIG. 6 is a flowchart to explain an ending part of the application phase of the desktop liquid-material applying apparatus according to the embodiment.

FIGS. 4, 5 and 6 illustrate one example of an operation flow of the desktop liquid-material applying apparatus according to the embodiment. The operation flow will be described below with reference to FIGS. 4, 5 and 6.

[1] Preparation Phase

First, preparations prior to starting the application work are performed along a flow illustrated in FIG. 4. A nozzle 22, a container storing the liquid material, etc. are initially attached to the ejection device 21 such that the ejection device 21 is prepared into a state capable of ejecting the liquid material at any time. That ejection device 21 is mounted to and fixedly held at a predetermined position on the Z-axis driving mechanism 16 (STEP 11).

After fixedly holding the ejection device 21, a position of the fore end of the nozzle 22 attached to the ejection device 21 is adjusted in the height direction (STEP 12). In more detail, a Z-axis descent amount is first read when the distance measurement device 24 provides a value representing a reference position over the surface of the sensor 30. Then, the ejection device 21 is descended by the Z-axis driving mechanism 16, and a descent amount is read when the nozzle comes into contact with the touch sensor 30. A descent amount of the ejection device 21 during the application work is adjusted on the basis of those read descent amounts. The reason why the height corresponding to the reference position is measured by the distance measurement device 24 resides in that a mechanical mounting error cannot be made zero. In other words, while it is ideal that a contact surface of the touch sensor 30 constituting the calibration unit 28 and an application surface of the adjustment workpiece on the adjustment stage 29 are mounted at the same height as that of an application surface of the workpiece fixedly held on the application stage 27, a mechanical mounting error cannot be reduced to zero in practice. Thus, positional accuracy in the height direction of the ejection device 21 is increased by measuring the height in the calibration and the height during the application work, and by driving the Z-axis driving mechanism 16 in consideration of a difference (error) between them.

After adjusting the position of the fore end of the nozzle 22 in the height direction, a position of the fore end of the nozzle 22 in the horizontal direction is adjusted (STEP 13). In more detail, the liquid material is first actually applied to the adjustment workpiece in the form of, e.g., a dot or a line. Then, the nozzle and the image pickup device are moved through the same distance as a spacing distance between the nozzle and the image pickup device, and an image of the dot or the line formed by applying the liquid material is taken by the image pickup device. When the formed dot or line is positioned at a center of the taken image, the fore end of the nozzle 22 is positioned as per setting. On the other hand, when the formed dot or line is not positioned at the center of the taken image, this implies that the fore end of the nozzle 22 is deviated. Accordingly, a distance from the center of the image to the formed dot or a center of the formed line is measured, and the measured distance is stored as an adjustment amount. In the application work, the fore end of the nozzle is moved in consideration of the adjustment amount.

After adjusting the position of the fore end of the nozzle in the horizontal direction, an application amount of the liquid material is adjusted (STEP 14). The application amount can be measured by determining an area or a volume of the applied liquid material with the image pickup device 23 and the distance measurement device 24. Further, an ejection amount of the liquid material can be adjusted by comparing the determined area or volume with a setting value.

After completing the above-described steps, contamination with the liquid material possibly adhering to the fore end of the nozzle upon the application performed in STEP 13 and STEP 14 is finally removed by the nozzle cleaning mechanism 31 (STEP 15). Examples of the nozzle cleaning mechanism 31 usable here include the type blowing away the extra liquid material by blowing an air stream to the fore end of the nozzle 22, and the type absorbing the extra liquid material by sucking the fore end of the nozzle. It is to be noted that the nozzle cleaning step may be periodically during an application phase, described below, in addition to the preparation phase. With the periodical nozzle cleaning, the liquid material can be applied in a precise amount in a satisfactory form.

The above-described STEP 12 to STEP 15 may be successively carried out in an automatic manner.

[2] Application Phase

After the end of the preparation phase, the application work is started along a flow illustrated in FIG. 5.

First, a magazine A 44 containing plural workpieces 11 not yet subjected to the application work is placed on the magazine placement table A 46 of the loader 42, and an empty magazine B 45 for taking in workpieces having been subjected to the application work is placed on the magazine placement table B 47 of the unloader 43 (STEP 21).

Then, the placement table A 46 of the loader 42 is moved to a position where a first workpiece is to be taken out (STEP 22), and the placement table B 47 of the unloader 43 is moved to a position where the first workpiece is to be taken in (STEP 23). Here, the taking-out of the workpiece 11 from the magazine A 44 and the taking-in of the workpiece 11 into the magazine B 45 may be each performed by moving the placement table downward or upward.

Then, the first workpiece 11 is conveyed to the position of the application stage 27 (STEP 24). At that time, the stopper 32 on the unloader side (downstream side) is ascended, and after stopping the workpiece 11 at a position above the application stage 27 (i.e., at a working position), it is descended. Further, the application stage 27 is ascended to fixedly hold the workpiece 11 (STEP 25).

Then, the placement table A 46 of the loader 42 is moved to a position where a second workpiece is to be taken out (STEP 26), and the second workpiece is conveyed to a standby position (STEP 27). At that time, the stopper 32 on the loader side is ascended to stop the workpiece 11 at the standby position. After the second workpiece 11 has been taken out, the placement table A 46 of the loader 42 is moved to a position where a third workpiece is to be taken out (STEP 28).

Then, application of the liquid material is executed on the first workpiece 11 that is fixedly held by the application stage 27 (STEP 29). After executing the desired application work, the application stage 27 is descended and the workpiece 11 is released from the fixedly held state (STEP 30). Further, the workpiece 11 having been subjected to the application work is conveyed to the magazine B 45 of the unloader 43 and is taken into a first-workpiece receiving position of the magazine B 45 (STEP 31). At that time, because the stopper 32 on the loader side (upstream side) is kept in the ascended state, the second workpiece 11 at the standby position is not conveyed to the working position.

After the first workpiece 11 has been taken into the unloader-side magazine A 44, the loader-side stopper 32 is descended and the second workpiece at the standby position is conveyed to the working position (STEP 32). At that time, as in STEP 24, the unloader-side stopper 32 is ascended, and after stopping the workpiece at the position above the application stage 27, it is descended. Further, the application stage 27 is ascended to fixedly hold the workpiece (STEP 33).

Then, the third workpiece 11 is conveyed to the standby position (STEP 34). At that time, the loader-side stopper 32 is ascended to stop the third workpiece 11 at the standby position. After the third workpiece 11 has been taken out, the placement table A 46 of the loader 42 is moved to a position where a fourth workpiece is to be taken out (STEP 35). Simultaneously, the placement table B 47 of the unloader 43 is moved to a position where the second workpiece is to be taken in (STEP 36).

Thereafter, the application work is progressed in the same flow as that from STEP 29 to STEP 36. When the application work is executed on a number n of workpieces, the above-described steps are repeated before the execution of the application work on the (n−2)-th workpiece.

[3] Application Ending Phase

When the magazine contains a number n of workpieces, an application ending phase is progressed along a flow illustrated in FIG. 6.

The application of the liquid material is executed on the (n−2)-th workpiece 11 that is fixedly held by the application stage 27 (STEP 37). After the application work, the application stage 27 is descended to release the workpiece 11 from the fixedly held state (STEP 38). Further, the workpiece 11 having been subjected to the application work is conveyed to the magazine B 45 of the unloader 43 and is taken into an (n−2)-th-workpiece receiving position of the magazine B 45 (STEP 39). At that time, because the loader-side stopper 32 is kept in the ascended state, the (n−1)-th workpiece 11 at the standby position is not conveyed to the working position.

After the (n−2)-th workpiece 11 has been taken into the magazine B 45 of the unloader 43, the loader-side stopper 32 is descended and the (n−1)-th workpiece 11 at the standby position is conveyed to the working position (STEP 40). At that time, the unloader-side stopper 32 is ascended, and after stopping the workpiece at the position above the application stage 27, it is descended. Further, the application stage 27 is ascended to fixedly hold the workpiece (STEP 41).

Then, the n-th workpiece 11 is conveyed to the standby position (STEP 42). At that time, the loader-side stopper 32 is ascended to stop the workpiece 11 at the standby position. After the n-th workpiece has been taken out, there are no more workpieces in the loader-side magazine A 44. Therefore, the placement table A 46 of the loader 42 is not moved (STEP 43), while the placement table B 47 of the unloader 43 is moved to a position where the (n−1)-th workpiece is to be taken in (STEP 44).

The application of the liquid material is executed on the (n−1)-th workpiece 11 that is fixedly held by the application stage 27 (STEP 45). After the application work, the application stage 27 is descended and the workpiece 11 is released from the fixedly held state (STEP 46). Further, the workpiece 11 having been subjected to the application work is conveyed to the magazine B 45 of the unloader and is taken into an (n−1)-th-workpiece receiving position of the magazine B 45 (STEP 47).

After the (n−1)-th workpiece 11 has been taken into the magazine B 45 of the unloader 43, the loader-side stopper 32 is descended and the n-th workpiece 11 at the standby position is conveyed to the position of the application stage 27 (STEP 48). At that time, the unloader-side stopper 32 is ascended, and after stopping the workpiece 11 at the position above the application stage, it is descended. Further, the application stage 27 is ascended to fixedly hold the workpiece 11 (STEP 49).

After the n-th workpiece 11, i.e., the final workpiece, is conveyed to the position of the application stage 27, there is no need of conveying the next workpiece to the standby position (STEP 50) because no more workpieces are present in the magazine A 44 of the loader 42. Also, there is no need of moving the placement table A 46 of the loader 42 (STEP 51). On the other hand, the placement table B 47 of the unloader 43 is moved to a position where the n-th workpiece is to be taken in (STEP 52).

The application of the liquid material is executed on the n-th workpiece 11 that is fixedly held by the application stage 27 (STEP 53). After the application work, the application stage 27 is descended and the workpiece 11 is released from the fixedly held state (STEP 54). Further, the workpiece 11 having been subjected to the application work is conveyed to the magazine B 47 of the unloader 43 and is taken into an n-th-workpiece receiving position of the magazine B 47 (STEP 55). The application work on the number n of workpieces is thus completed.

When the application work for one magazine approaches the end, a care has to be taken of the fact that the moving and conveying operations are no longer required in the relevant portions, starting from the portion where workpieces are first depleted.

The application work can be continuously executed by newly placing a magazine containing workpieces not yet subjected to the application work or an empty magazine on the corresponding magazine placement table, respectively, at good timing when the loader-side magazine A 46 becomes empty, or when the unloader-side magazine B 47 becomes full.

While the above description is made in connection with the case performing the steps one by one in series, some of the steps capable of being progressed simultaneously may be performed simultaneously. This contributes to cutting the working time. For example, the conveying of the workpiece having been subjected to the application work to the unloader (e.g., STEP 31 and 39) and the conveying of the workpiece not yet subjected to the application work to the position of the application stage 27 (e.g., STEP 32 and 40) may be performed simultaneously. In order to stop the workpiece not yet subjected to the application work above the application stage 27, however, the unloader-side stopper 32 needs to be ascended immediately after passage of the workpiece having been subjected to the application work. Accordingly, a sensor or the like for sensing the passage of the workpiece is required. A practical arrangement may be selected, as appropriate, taking into account a reduction of the working time and a control process.

[Advantageous Effect of Embodiment 1]

The desktop full-automatic liquid-material applying apparatus, constructed as described above, according to this embodiment has the following features.

First, the control unit is separated into the first control unit 34 for controlling the workpiece conveying mechanism 17 and the head moving mechanism 13, and the second control unit 35 for controlling the ejection device 21. The first control unit 34 and the second control unit 35 are installed in separate places. Therefore, the height of the base body (body under the base plate) 26 in which the control unit is entirely installed in the past can be reduced. More specifically, the height of the base body 26 can be reduced to 200 mm while the overall height of the apparatus is 1000 mm. Furthermore, since the position of the conveying rails 18 can be lowered, the worker can visually confirm the operations made on the workpiece 11 even when the apparatus is installed on a desk.

Secondly, the head moving mechanism 13 is constituted, in more detail, by mounting the Y-axis driving mechanism 15 on the X-axis driving mechanism 14, mounting the Z-axis driving mechanism 16 on the Y-axis driving mechanism 14, and mounting the ejection device 21, the image pickup device 23, and the distance measurement device 24 on the Z-axis driving mechanism 16. On that occasion, the ejection device 21, the image pickup device 23, the distance measurement device 24, and the Y-axis driving mechanism 15 are arranged in overhanging relation to the workpiece conveying mechanism 17. Moreover, the Z-axis driving mechanism is disposed such that, when the Z-axis driving mechanism 16 is positioned at one end of a Y-stroke, it is positioned on a center line of the X-axis. With that arrangement, so-called dead space can be utilized, and hence a bottom area of the base body 26 can be reduced. More specifically, an area of the base plate 25 can be reduced to the A2 size (width of 594 mm and depth of 420 mm).

Thirdly, since the loader 42 and the unloader 43 are fixedly mounted to only the base body 25 in a detachable manner, the apparatus can be easily modified to a construction not including the loader 42 and the unloader 43. Furthermore, since the loader 42 and the unloader 43 are not provided with separate legs, a desk area necessary for installing the apparatus can be set to be the same as a bottom area of the main body of the apparatus.

LIST OF REFERENCE SYMBOLS

10 desktop full-automatic liquid-material applying apparatus
11 workpiece
12 main body
13 head moving mechanism
14 X-axis driving mechanism
15 Y-axis driving mechanism
16 Z-axis driving mechanism
17 workpiece conveying mechanism
18 conveying rail
19 belt
20 workpiece fixing member
21 ejection device (dispensing head)
22 nozzle
23 image pickup device (CCD camera)
24 distance measurement device (laser optical displacement meter)
25 base plate (upper surface of base body)
26 base body (body under base plate)
27 application stage
28 calibration unit
29 adjustment stage (testing stage)
30 touch sensor
31 nozzle cleaning mechanism
32 stopper
33 leg (adjuster pad)
34 first control unit (driving system control unit)
35 second control unit (dispensing controller)
36 third control unit (image processing PC)
37 cover (casing)
38 emergency stop button
39 door
40 indicating lamp
41 operating unit (touch panel)
42 loader
43 unloader
44 magazine A
45 magazine B
46 magazine placement table A
47 magazine placement table B
48 pedestal
50 opening
51 moving direction (X)
52 moving direction (Y)
53 moving direction (Z)
54 conveying direction (workpiece)
55 moving direction (magazine)

The invention claimed is:

1. A desktop working apparatus for performing desired operations on a workpiece while the workpiece and a working head are relatively moved, the desktop working apparatus comprising:

a base body;

a working section disposed on the base body and including the working head and a working head driving mechanism;

a loader integrally disposed at a side of the desktop working apparatus;

an unloader integrally disposed at a side of the desktop working apparatus;

a conveying section disposed on the base body and conveying the workpiece supplied from the loader to the unloader; and a control unit, wherein the conveying section includes a fixing mechanism for fixedly holding the workpiece at a working position, the working section includes the working head disposed above the working position, and the control unit includes a first control unit disposed within the base body, and a second control unit disposed at a side or a top of the desktop working apparatus, wherein the conveying section includes a conveying rail disposed on the base body and conveying the workpiece, and an application stage arranged at the working position, and the fixing mechanism comprises a fixing member to fixedly sandwich the workpiece at the working position.

2. The desktop working apparatus according to claim 1, wherein the working head driving mechanism includes an X-axis driving mechanism for moving the working head parallel to a conveying direction of the conveying section, a Y-axis driving mechanism for moving the working head in a direction perpendicular to the conveying direction of the conveying section, and a Z-axis driving mechanism for moving the working head in an up and down direction, the Y-axis driving mechanism being disposed in overhanging relation to the conveying section.

3. The desktop working apparatus according to claim 1, further comprising a casing that is disposed on the base body and that covers the working section and the conveying section.

4. The desktop working apparatus according to claim 3, wherein the second control unit is disposed at a side or a top of the casing.

5. The desktop working apparatus according to claim 1, wherein the first control unit is a control unit for controlling the working head driving mechanism and the conveying section, and the second control unit is a control unit for controlling the working head, or wherein the first control unit is a control unit for controlling the working head, and the second control unit is a control unit for controlling the working head driving mechanism and the conveying section.

6. The desktop working apparatus according to claim 1, wherein the loader includes a magazine charging portion that is positioned 80 cm or less above a desk.

7. The desktop working apparatus according to claim 1, wherein the loader includes a magazine charging portion that is positioned 60 cm or less above a desk.

8. The desktop working apparatus according to claim 1, wherein a height of the conveying section is set such that an upper surface of the workpiece placed on the conveying section is positioned 80 cm or less above a desk.

9. The desktop working apparatus according to claim 1, wherein a height of the conveying section is set such that an upper surface of the workpiece placed on the conveying section is positioned 60 cm or less above a desk.

10. The desktop working apparatus according to claim 1, wherein a height of the base body is ½ or less of a height of the desktop working apparatus.

11. The desktop working apparatus according to claim 1 wherein a height of the base body is ¼ to ⅙ of a height of the desktop working apparatus.

12. The desktop working apparatus according to claim 1, wherein the working section includes the working head, a distance measurement device, and an image pickup device, which are integrally disposed in series parallel to the conveying direction of the conveying section.

13. The desktop working apparatus according to claim 1, wherein the working head is an ejection head.

14. A desktop working apparatus for performing desired operations on a workpiece while the workpiece and a working head are relatively moved, the desktop working apparatus comprising:

a base body;

a working section disposed on the base body and including the working head and a working head driving mechanism;

a loader integrally disposed at a side of the desktop working apparatus;

an unloader integrally disposed at a side of the desktop working apparatus;

a conveying section disposed on the base body and conveying the workpiece supplied from the loader to the unloader; and a plurality of control units arranged in a distributed way, wherein the conveying section includes a fixing mechanism for fixedly holding the workpiece at a working position, the working section includes the working head disposed above the working position, and a height of the conveying section is set such that an upper surface of the workpiece placed on the conveying section is positioned 80 cm or less above a desk, wherein the conveying section includes a conveying rail disposed on the base body and conveying the workpiece, and an application stage arranged at the working position, and the fixing mechanism comprises a fixing member to fixedly sandwich the workpiece at the working position.

15. The desktop working apparatus according to claim 14, wherein the height of the conveying section is set such that the upper surface of the workpiece placed on the conveying section is positioned 60 cm or less above the desk.

16. The desktop working apparatus according to claim 14, wherein at least one of the distributed control units is disposed within the base body.

17. The desktop working apparatus according to claim 14, wherein a height of the base body is ½ or less of a height of the desktop working apparatus.

18. The desktop working apparatus according to claim 14, wherein a height of the base body is ¼ to ⅙ of a height of the desktop working apparatus.

19. The desktop working apparatus according to claim 14, wherein the working section includes the working head, a distance measurement device, and an image pickup device, which are integrally disposed in series parallel to the conveying direction of the conveying section.

20. The desktop working apparatus according to claim 14, wherein the working head is an ejection head.

21. A desktop working apparatus for performing desired operations on a workpiece while the workpiece and a working head are relatively moved, the desktop working apparatus comprising:

a base body;

a working section disposed on the base body and including the working head and a working head driving mechanism;

a loader integrally disposed at a side of the desktop working apparatus;

an unloader integrally disposed at a side of the desktop working apparatus;

a conveying section disposed on the base body and conveying the workpiece supplied from the loader to the unloader; and a control unit, wherein the conveying section includes a fixing mechanism for fixedly holding the workpiece at a working position, the working section includes the working head disposed above the working position, and the control unit includes a first control unit disposed within the base body, and a second control unit disposed at a side or a top of the desktop working apparatus, wherein the loader moves a plurality of first vertically stacked magazine tables up and down while always holding constant a relative distance between adjacent magazine tables in the first vertically stacked magazine tables, and supplies the workpiece contained in a magazine to the conveying section, the magazine being placed on the magazine table, and wherein the unloader moves a plurality of second vertically stacked magazine tables up and down while always holding constant a relative distance between adjacent magazine tables in the second vertically stacked magazine tables, and takes in the workpiece discharged from the conveying section into a magazine that is placed on the magazine table.

22. The desktop working apparatus according to claim 21, wherein a height of the workpiece placed on the conveying section is greater than a length from a lower end of the magazine table to an upper end of the magazine placed on the magazine table.

23. A desktop working apparatus for performing desired operations on a workpiece while the workpiece and a working head are relatively moved, the desktop working apparatus comprising:

a base body;

a working section disposed on the base body and including the working head and a working head driving mechanism;

a loader integrally disposed at a side of the desktop working apparatus;

an unloader integrally disposed at a side of the desktop working apparatus;

a conveying section disposed on the base body and conveying the workpiece supplied from the loader to the unloader; and a plurality of control units arranged in a distributed way, wherein the conveying section includes a fixing mechanism for fixedly holding the workpiece at a working position, the working section includes the working head disposed above the working position, and a height of the conveying section is set such that an upper surface of the workpiece placed on the conveying section is positioned 80 cm or less above a desk, wherein the loader moves a plurality of first vertically stacked magazine tables up and down while always holding constant a relative distance between adjacent magazine tables in the first vertically stacked magazine tables, and supplies the workpiece contained in a magazine to the conveying section, the magazine being placed on the magazine table, and wherein the unloader moves a plurality of second vertically stacked magazine tables up and down while always holding constant a relative distance between adjacent magazine tables in the second vertically stacked magazine tables, and takes in the workpiece discharged from the conveying section into a magazine that is placed on the magazine table.

24. The desktop working apparatus according to claim 23, wherein a height of the workpiece placed on the conveying section is greater than a length from a lower end of the magazine table to an upper end of the magazine placed on the magazine table.

* * * * *